US008166658B2

(12) United States Patent
Nakasuka

(10) Patent No.: US 8,166,658 B2
(45) Date of Patent: May 1, 2012

(54) RAZOR

(75) Inventor: Hiroyuki Nakasuka, Seki (JP)

(73) Assignee: KAI R&D Center Co., Ltd., Gifu-ken (JP)

( * ) Notice: Subject to any disclaimer, the term of this patent is extended or adjusted under 35 U.S.C. 154(b) by 524 days.

(21) Appl. No.: 12/311,242

(22) PCT Filed: Oct. 26, 2007

(86) PCT No.: PCT/JP2007/070961

§ 371 (c)(1), (2), (4) Date: Mar. 24, 2009

(87) PCT Pub. No.: WO2008/053814

PCT Pub. Date: May 8, 2008

(65) Prior Publication Data

US 2009/0307908 A1 Dec. 17, 2009

(30) Foreign Application Priority Data

Oct. 31, 2006 (JP) ..... 2006-295561

(51) Int. Cl.
*B26B 19/40* (2006.01)
*B26B 21/52* (2006.01)

(52) U.S. Cl. ..... 30/41; 30/50; 30/532

(58) Field of Classification Search ..... 30/34.05, 30/41, 50, 527, 537, 538
See application file for complete search history.

(56) References Cited

U.S. PATENT DOCUMENTS 2,677,883 A 5/1954 Schallgruber
3,969,817 A 7/1976 DiBuono
4,944,090 A 7/1990 Sumnall
5,134,775 A 8/1992 Althaus et al.
7,367,125 B2 * 5/2008 Aviza ..... 30/34.05
7,540,088 B2 * 6/2009 Takeshita ..... 30/34.2
7,877,879 B2 * 2/2011 Nakasuka ..... 30/41
7,971,363 B2 * 7/2011 Nakasuka ..... 30/532
2003/0200660 A1 10/2003 Pennella et al.
2006/0080837 A1 4/2006 Johnson et al.

(Continued)

FOREIGN PATENT DOCUMENTS

FR 1177096 4/1959

(Continued)

OTHER PUBLICATIONS

European Search Report issued by the European Patent Office on Nov. 4, 2010 in connection with corresponding European patent application No. 07830695.8-2313 (and English translation).

(Continued)

*Primary Examiner* — Hwei C Payer
(74) *Attorney, Agent, or Firm* — Posz Law Group, PLC

(57) ABSTRACT

A shaving aid member pivots in a predetermined range from an initial position to a pivot position with respect to a razor head against elastic force of leaf springs. In the shaving aid member, a mounting portion of a base member is aligned with the razor head and two arm portions of the base member are invisible from the front side of the razor head. This reduces the space occupied by the arm portions outside the outer peripheral portion of the razor head. As a result, in a razor with a shaving aid, comfort in use is enhanced. Further, the razor is compact-sized since the surface area of the front side of the portion outlined by the razor head and the shaving aid member is decreased.

9 Claims, 6 Drawing Sheets

U.S. PATENT DOCUMENTS

| | | | | |
|---|---|---|---|---|
| 2006/0143925 | A1 | 7/2006 | Johnson et al. | |
| 2010/0154220 | A1 * | 6/2010 | Nakasuka | 30/41.6 |

FOREIGN PATENT DOCUMENTS

| | | |
|---|---|---|
| JP | A-2001-38072 | 2/2001 |
| JP | A-2007-068923 | 3/2007 |
| JP | A-2007-215589 | 8/2007 |
| JP | A-2007-215590 | 8/2007 |
| JP | A-2007-215591 | 8/2007 |

OTHER PUBLICATIONS

International Preliminary Report on Patentability issued from the International Bureau of WIPO on May 26, 2009 in the corresponding International patent application No. PCT/JP2007/070961.

International Search Report mailed on Jan. 29, 2008 for the corresponding International patent application No. PCT/JP2007/070961 (English translation enclosed).

* cited by examiner

RAZOR

CROSS REFERENCE TO RELATED APPLICATIONS

This application is a U.S. national stage application of PCT/JP2007/070961 filed on Oct. 26, 2007, and claims priority to, and incorporates by reference, Japanese Patent Application No. 2006-295561 filed on Oct. 31, 2006.

FIELD OF THE INVENTION

The present invention relates to a razor having a shaving aid arranged in a razor head with a blade.

BACKGROUND OF THE INVENTION

Conventionally, as described in Patent Document 1, a shaving aid is embedded in and exposed from a top plate of a razor head. However, since the shaving aid is fixed to the top plate of the razor head, the shaving aid may press the surface of the skin with excessive force when the razor head is applied to the skin surface, thus degrading comfort in use of the razor.

Patent Document 1: Japanese Laid-Open Patent Publication No. 2001-38072

SUMMARY OF THE INVENTION

Accordingly, it is an objective of the present invention to provide a razor with a shaving aid that is not only capable of enhancing comfort in use, but also compact-sized with a reduced surface area of a front side of a portion outlined by a razor head and a shaving aid member.

To achieve the foregoing objective and in accordance with one aspect of the present invention, a razor includes a shaving aid member attached to a razor head having a blade body. A coupling portion is provided at a backside of the razor head opposite to a front side of the razor head through which a cutting edge of the blade body is exposed. The coupling portion supports the shaving aid member such that the shaving aid member is movable with respect to the razor head.

This configuration reduces the space occupied by the coupling portion outside the outer peripheral portion of the razor head. The surface area of the front side of the portion outlined by the razor head and the shaving aid member is thus decreased so that the razor is compact.

The coupling portion preferably includes an arm portion arranged in a base member on which a shaving aid is mounted in the shaving aid member and a support portion provided at the backside of the razor head. Also, the arm portion is preferably supported to be movable with respect to the support portion in such a manner that the arm portion faces the backside of the razor head surrounded by an outer peripheral portion of the razor head.

The shaving aid member is preferably capable of reciprocating and movable in a predetermined movement range between an initial position, at which the shaving aid member is urged by elastic force of an elastic body in a proceeding direction and stops, and a movement position, to which the shaving aid member is moved in a returning direction against the elastic force of the elastic body.

A first movement stopping portion that prevents the shaving aid member from moving in the proceeding direction beyond the initial position is preferably provided.

A second movement stopping portion that prevents the shaving aid member from moving in the returning direction beyond the movement position is preferably provided.

If a first movement stopping portion that prevents the shaving aid member from moving in the proceeding direction beyond the initial position and a second movement stopping portion that prevents the shaving aid member from moving in the returning direction beyond the movement position are provided, the movement of the shaving aid member is preferably pivoting motion and the axis of the pivoting motion of the shaving aid member is preferably located between the first movement stopping portion and the second movement stopping portion.

The second movement stopping portion preferably has a movement permitting space between a contact surface provided on the backside of the razor head and a contact surface provided in the arm portion of the base member.

The coupling portion is preferably arranged at each of two sides of a cutting edge of the blade at the backside of the razor head.

The elastic body is preferably provided in the base member of the shaving aid member.

The elastic body is preferably provided between the arm portions of the two coupling portions in the base member.

The shaving aid member is preferably supported in such a manner that the shaving aid member is allowed to oscillate about a pivot axis extending in an extending direction of the cutting edge of the blade body and in a predetermined pivot range between an initial position and a pivot position with respect to the razor head.

The razor head is preferably supported by a holder at an attaching portion provided at the backside of the razor head, the attaching portion being arranged between the support portions of the two coupling portions.

The razor head is preferably supported in the attaching portion provided at each of two sides of the blade body at the backside of the razor head in such a manner that the razor head is allowed to pivot about the pivot axis extending in the extending direction of the cutting edge of the blade body with respect to a holder. Also, the attaching portions having a pivot axis of the razor head and the coupling portion having the pivot axis of the shaving aid member are preferably aligned along the extending direction of the cutting edge of the blade body.

A guard is preferably provided in an assembling member in which the blade body is mounted in such a manner that the guard faces the cutting edge of the blade body, and wherein the shaving aid member is aligned at the side opposite to the guard with respect to the assembling member of the razor head.

In the assembling member, the blade body is preferably provided between the blade base and the top plate and the cutting edge of the blade body is preferably exposed to the front side of the top plate. Also, when the shaving aid member is at the initial position, a shaving aid preferably projects from a skin contact surface connecting the guard and the top plate to each other to the front side of the top plate.

The arm portion is preferably arranged inside a range corresponding to the backside of the razor head and overlaps the backside.

BRIEF DESCRIPTION OF THE DRAWINGS

FIG. 1(*b*) is a perspective view illustrating a backside of the razor;

FIG. 2(*b*) is a rear view illustrating a backside of the razor head;

FIG. 2(*c*) is a side view illustrating the razor head;

FIG. 2(*d*) is a partial cross-sectional view illustrating a portion of FIG. 2(*b*) as viewed from the bottom;

FIG. 3(*b*) is a rear view illustrating a backside of the shaving aid member;

FIG. 3(*c*) is a side view, with a part cutaway, illustrating the shaving aid member;

FIG. 4(*b*) is a side view illustrating the head of the holder of the oscillating type razor;

FIG. 5(*b*) is a rear view illustrating the backside of the razor head supporting the shaving aid member;

FIG. 6(*b*) is a side view illustrating a state in which the shaving aid member is located at a pivot position in the razor head supported by the head of the holder;

FIG. 6(*c*) is a side view showing a transitional state of the shaving aid member located between the initial position and the pivot position;

FIG. 7(*b*) is a cross-sectional view of FIG. 7(*a*) as viewed from behind; and FIG. 7(*c*) is a cross-sectional view of FIG. 7(*a*) as viewed from the side.

DETAILED DESCRIPTION OF THE INVENTION

An oscillating type razor according to one embodiment of the present invention will now be described with reference to the attached drawings.

Figure 1:
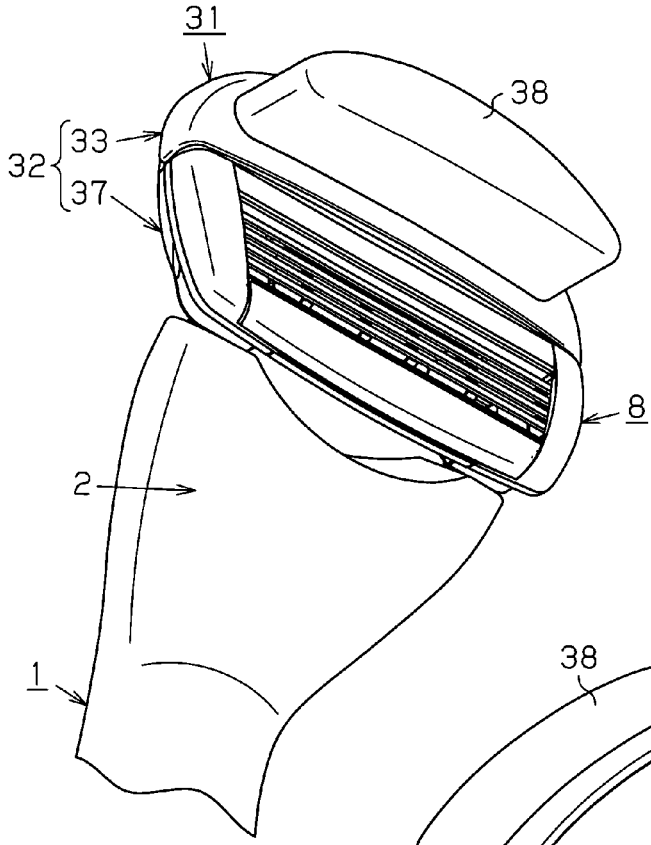
FIG. 1(*a*) is a perspective view illustrating a front side of an oscillating type razor according to one embodiment of the present invention.
Figure 1:
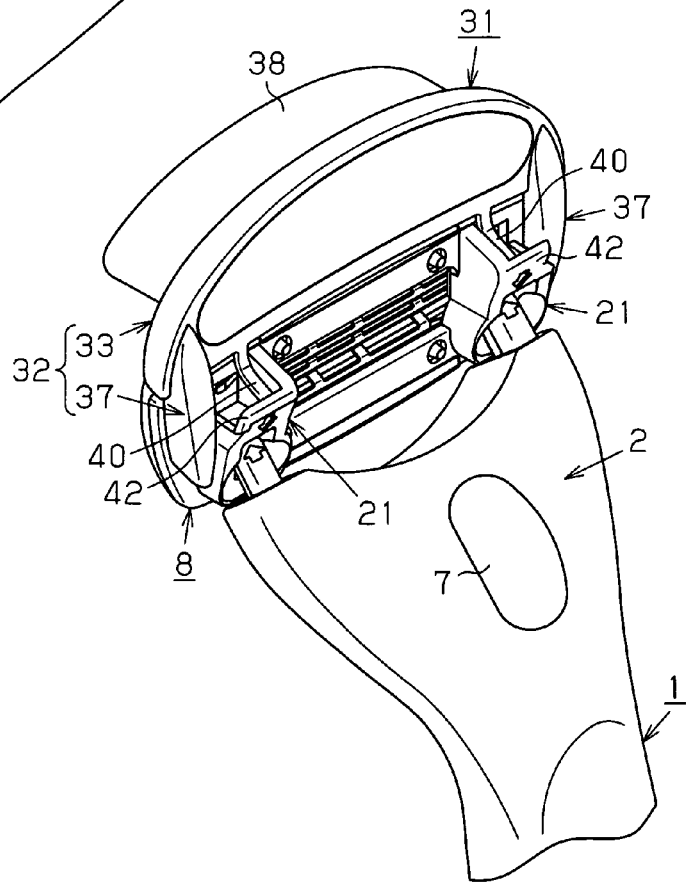
Figure 2A:
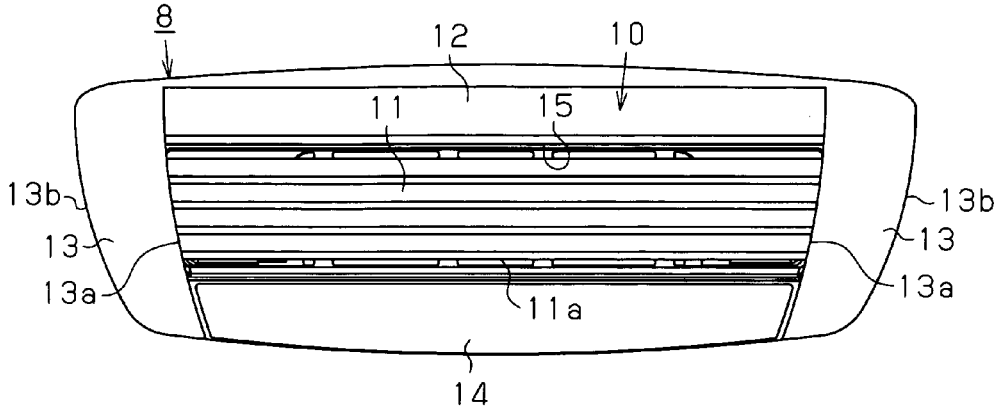
FIG. 2(*a*) is a front view illustrating a front side of a razor head.
Figure 2B:
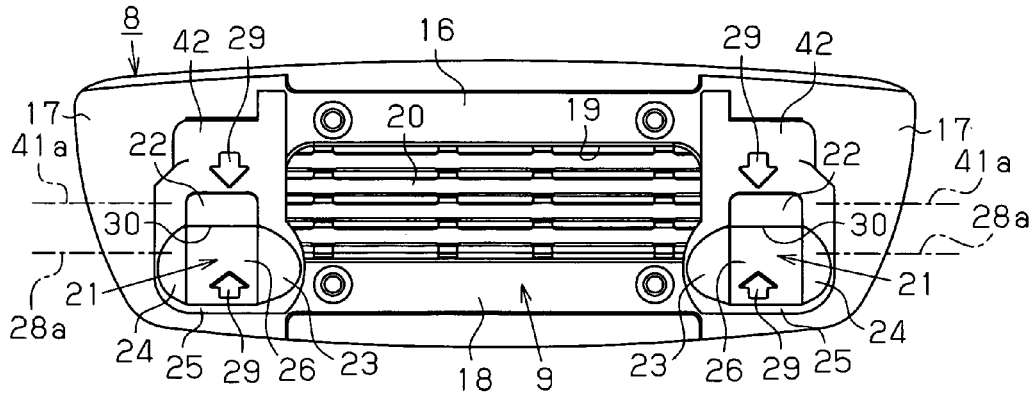
Figure 2C:
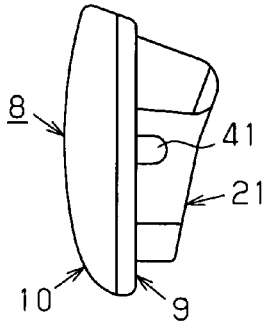
Figure 2D:
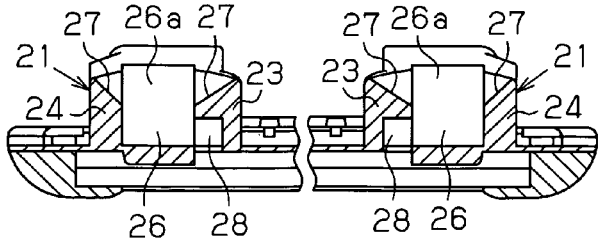
Figure 3A:
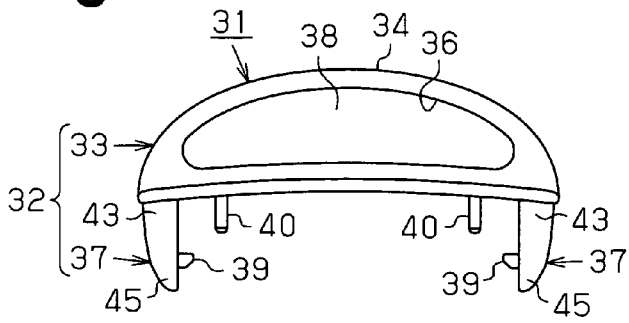
FIG. 3(*a*) is a front view illustrating a front side of a shaving aid member.
Figure 3B:
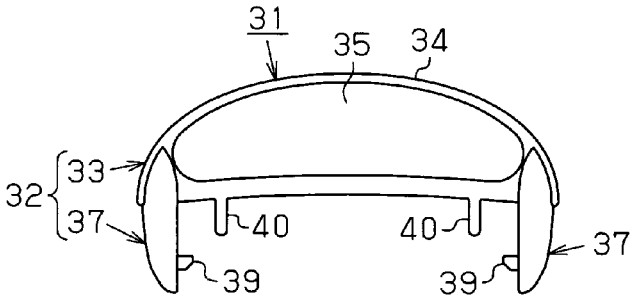
Figure 3C:
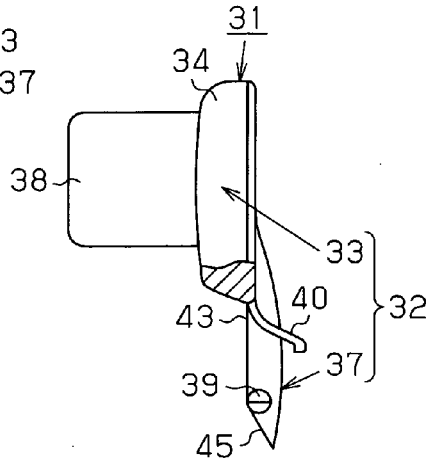

As shown in FIGS. 1(*a*), 1(*b*), 4(*a*), and 4(*b*), a holder 1 molded from plastic includes left and right metal support arms 3 and bifurcated plastic pushers 4, which project from both sides of a front end of a head 2. The left and right support arms 3 are supported so as to pivot in a left-right direction Y. Each of the support arms 3 has an outer arm portion 5 projecting outward from the head 2. A hook-like end portion 5*a* is formed in the outer arm portion 5 of each of the left and right support arms 3 in such a manner that the hook-like end portions 5*a* are opposed to each other along the left-right direction Y.

Each pusher 4 is supported to be movable in a forward-rearward direction X with respect to the head 2 and has an outer arm portion 6, which is provided in the vicinity of the outer arm portion 5 of the corresponding one of the left and right support arms 3 and projects outward from the head 2. A press contact end portion 6*a* is formed in the outer arm portion 6 of each of the left and right pushers 4. The outer arm portion 5 of each support arm 3 and the outer arm portion 6 of the corresponding pusher 4 are located adjacent to each other along an up-down direction Z.

Figure 4A:
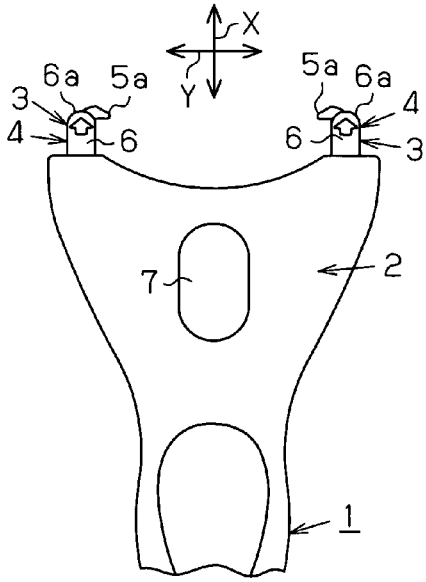
FIG. 4(*a*) is a plan view illustrating a head of a holder of the oscillating type razor.
Figure 4B:
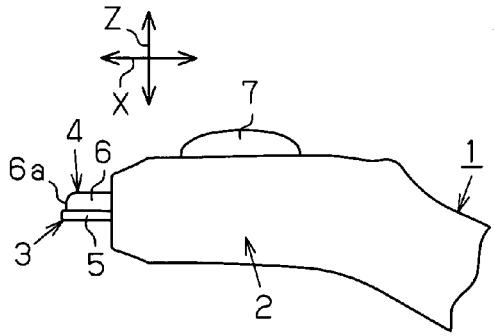

As is widely known, by pressing a manipulating knob 7, which is exposed from the head 2, forward from a non-manipulated state against elastic force, the outer arm portions 5 of the left and right support arms 3 spread open with respect to each other from a maximally closed state illustrated in FIG. 4(*a*). In this state, by releasing the manipulating knob 7, the manipulating knob 7 restores the non-manipulated state and the outer arm portions 5 of the support arms 3 return to the maximally closed state.

In a razor head 8 shown in FIGS. 1(*a*), 1(*b*), 2(*a*), 2(*b*), 2(*c*), 2(*d*), 5(*a*), and 5(*b*), a plurality of (for example, four) blade bodies 11 are clamped between a blade base 9, which is formed of plastic and serves as an assembling member, and a top plate 10.

The top plate 10 is shaped like a frame and has an upper frame portion 12, left and right frame portions 13, and a guard 14 (a lower frame portion). The left and right frame portions 13 each extend continuously from the corresponding one of the left and right sides of the upper frame portion 12. The guard 14 is provided between the left and right frame portions 13. A window 15 surrounded by the upper frame portion 12, the left and right frame portions 13, and the guard 14 exposes cutting edges 11*a* of the blade bodies 11 to the front side, so that the cutting edges 11*a* face the guard 14. A shaving aid is formed integral with the surface of the guard 14 through injection molding.

In the left and right frame portions 13, the interval between left and right inner end portions 13*a* and the interval between left and right outer end portions 13*b* become gradually greater from the guard 14 toward the upper frame portion 12. The dimensions of exposure of the cutting edges 11*a* of the blade bodies 11 through the window 15 become greater toward the vicinity of the upper frame portion 12 than the vicinity of the guard 14. As a result, a cutting edge 11*a* spaced from the guard 14 cuts the hair that has not been removed by a cutting edge 11*a* closer to the guard 14, thus preventing incomplete shaving.

The blade base 9 has a frame-like shape and has an upper frame portion 16, left and right frame portions 17, and a lower frame portion 18. The upper frame portion 16 overlaps the upper frame portion 12 of the top plate 10. The left and right frame portions 17 each overlap the corresponding one of the left and right frame portions 13 of the top plate 10. The lower frame portion 18 overlaps the guard 14 of the top plate 10. A seat 20, which elastically receives the blade bodies 11, is exposed from a discharge opening 19 surrounded by the upper frame portion 16, the left and right frame portions 17, and the lower frame portion 18. The seat 20 brings out cushion function through a spring (not shown) provided in the seat 20 by flexibly deforming in correspondence with the force applied to the blade bodies 11 when the razor is used.

An attaching portion 21 is formed in each of the left and right frame portions 17 of the blade base 9 at the backside of the razor head 8, which is located opposite to the front side. As illustrated in FIGS. 2(*b*), 2(*c*), 2(*d*), 5(*b*), 7(*a*), 7(*b*), and 7(*c*), a hollow portion 26, which is surrounded by an upper wall portion 22, two side wall portions 23, 24, and a lower wall portion, is formed in each of the left and right attaching portions 21. A guide surface 27, which is inclined toward the bottom of the corresponding one of the hollow portions 26, is formed in the inner surface of each of the sidewall portions 23, 24 in the vicinity of an inlet 26*a* of the hollow portion 26.

Left and right attaching openings 28, which are located at the bottoms of the corresponding hollow portions 26, are formed in the opposed ones of the sidewall portions 23, 24 of the attaching portions 21, which are the sidewall portions 23. A pivot axis 28*a*, which extends in such a manner as to connect the left and right attaching openings 28 to each other, extends in the left-right direction Y, or the direction in which each cutting edge 11*a* extends. Arrows 29 pointing to the corresponding hollow portions 26 are provided on the inner surfaces of the upper wall portions 22 and the inner surfaces of the lower wall portions 25 in the vicinity of the inlets 26*a* of the hollow portions 26. A pressing portion 30 is formed on the inner surface of each upper wall portion 22 in the vicinity of the inlet 26*a* of the corresponding hollow portion 26.

In a shaving aid member 31 shown in FIGS. 1(*a*), 1(*b*), 3(*a*), 3(*b*), 3(*c*), 5(*a*), and 5(*b*), a base member 32 formed of plastic includes a mounting portion 33 and two arm portions 37. The mounting portion 33 has a back lid 35 fitted in a frame portion 34 of the mounting portion 33. A recess 36 is defined in the front side of the back lid 35. The two arm portions 37 project from the frame portion 34 at both left and right sides of the mounting portion 33. A shaving aid 38 is fitted and mounted in the recess 36. The shaving aid 38 is, for example, an alkaline soap of a mass of approximately 2.5 g.

Inclined surfaces (not shown) are formed in the frame portion 34 and the shaving aid 38 at both upper and lower sides of the recess 36. The inclined surfaces are matched together to prevent the shaving aid 38 from separating from the frame portion 34 toward the front side when the shaving aid 38 is fitted in the frame portion 34 from the backside. The back lid 35 is deposited onto the frame portion 34 with adhesive applied between the back lid 35, which is fitted in the frame portion 34, and the shaving aid 38. A number of projections that bite into the inclined surfaces of the shaving aid 38 may be formed in the inclined surfaces of the frame portion 34. Alternatively, a non-smooth rough surface may be formed on the inclined surfaces of the frame portion 34 through texturing in order to increase the friction resistance between the inclined surfaces of the frame portion 34 and the inclined surfaces of the shaving aid 38.

Opposed support shafts 39 are provided in the vicinities of the distal portions of the left and right arm portions 37 of the base member 32. Left and right leaf springs 40, each serving as a cantilevered elastic body, are formed in curved shapes integral with and adjacent to the corresponding left and right arm portions 37. The leaf springs 40 may be extended linearly. Alternatively, either one of the left and right leaf springs 40 may be omitted. Further, any suitable types of springs, other than the leaf springs 40, may be employed as the elastic bodies.

The dimension of the base member 32 in the left-right direction Y is approximately 44 mm. The dimension of the shaving aid 38 in the left-right direction Y is approximately 34 mm. The width of the surface of the shaving aid 38 in a direction perpendicular to the left-right direction Y is maximum at the center of the left-right direction Y, and is approximately 8 mm. The shaving aid 38 projects from the surface of the base member 32 by a height of approximately 8 mm. The shaving aid 38 may be not only a single compound such as the aforementioned soap, shaving cream, lubricant aid, hair softener, hair remover, after-shave lotion, moisturizer, and hemostatic agent, but also a composite formed by combining any of these single compounds or a porous body such as a sponge impregnated with any one of the single compounds or composites.

Figure 5A:
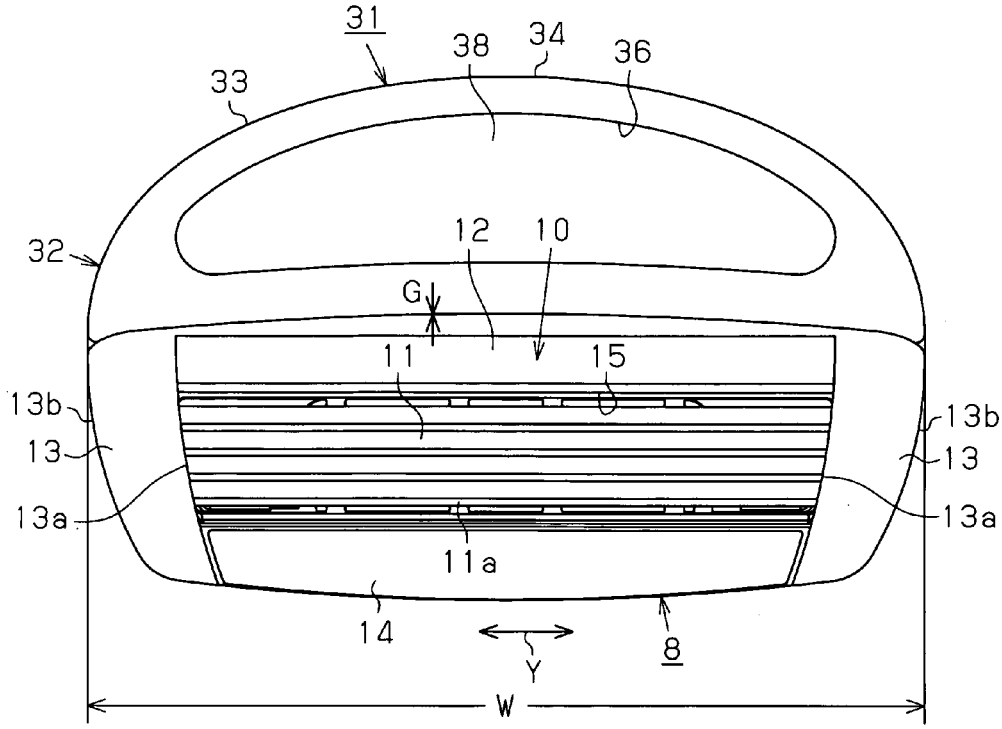
FIG. 5(*a*) is a front view illustrating the front side of the razor head supporting the shaving aid member.
Figure 5B:
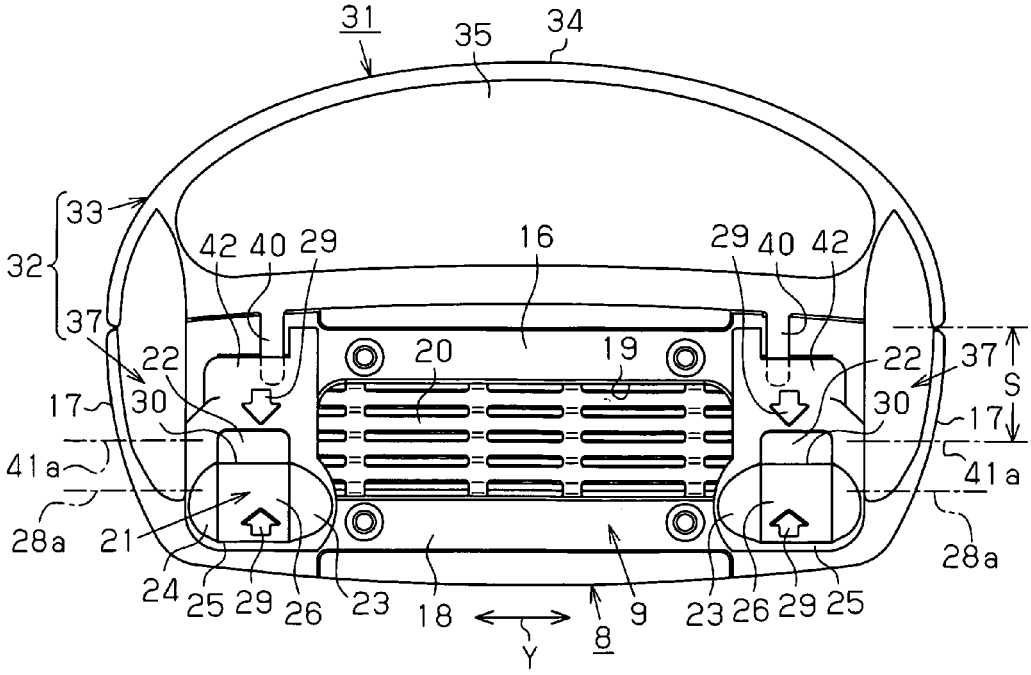

With reference to FIGS. 5(*a*) and 5(*b*), in the shaving aid member 31, the mounting portion 33 of the base member 32 and the shaving aid 38 mounted on the mounting portion 33 are arranged side by side at the side opposite to the guard 14 and the lower frame portion 18 of the razor head 8 with respect to the upper frame portions 12, 16 of the razor head 8. The upper frame portion 12 of the top plate 10 is formed in a convex shape with a radius of curvature of approximately 200 mm in such a manner as to project toward the frame portion 34 of the mounting portion 33. The portion of the frame portion 34 overlapping the upper frame portion 12 is formed in a concave shape matching the convex shape of the upper frame portion 12 with a slight clearance G (approximately 0.5 mm) between the frame portion 34 and the upper frame portion 12. The maximum interval (the maximum lateral dimension W in the left-right direction Y) between the left and right outer end portions 13*b* of the left and right frame portions 13 of the top plate 10 is equal to the maximum interval of the frame portion 34 at the portion of the frame portion 34 overlapping the upper frame portion 12.

The left and right arm portions 37 of the base member 32 overlap the corresponding left and right frame portions 17 of the blade base 9 and are arranged adjacent to the corresponding left and right attaching portions 21 at the backside of the razor head 8. The left and right attaching portions 21 are arranged between the left and right arm portions 37. With reference to FIGS. 2(*c*) and 7(*b*), a support hole 41 extending in the left-right direction Y is formed in the sidewall portion 24 of each one of the left and right attaching portions 21 located adjacent to the corresponding one of the left and right arm portions 37. A pivot axis 41*a* extending in such a manner as to connect the left and right support holes 41 to each other extends along the left-right direction Y (the extending direction of each cutting edge 11*a*) and parallel with the pivot axis 28*a* extending between the left and right attaching openings 28 in the vicinity of the pivot axis 28*a*. The distance S between the base of each of the left and right arm portions 37 and the pivot axis 41*a* is set to approximately 7 mm. The support shafts 39 of the left and right arm portions 37 (the coupling portions) are received in the support holes 41 of the corresponding left and right sidewall portions 24 (the support portions serving as the coupling portions) in such a manner that the support shafts 39 are allowed to pivot with respect to the support holes 41.

The left and right leaf springs 40 of the base member 32 are held in contact with press contact plate portions 42, each of which extends from the upper wall portion 22 of the corresponding one of the left and right attaching portions 21. As a result, the shaving aid member 31 is supported in such a manner that the shaving aid member 31 is allowed to pivot about the pivot axis 41*a* extending between the left and right support holes 41, so that the shaving aid member 31 oscillates along a direction extending between the front side and the backside of the razor head 8 with respect to the razor head 8.

Contact surfaces 43, each of which serves as a first movement stopping portion, are formed in the basal portions of the left and right arm portions 37. Contact surfaces 44, each of which serves as a first movement stopping portion, are formed in the left and right frame portions 17, which face the corresponding left and right arm portions 37. Each one of the contact surfaces 43 and the corresponding one of the contact surfaces 44 thus face each other. Contact surfaces 45, each of which serves as a second movement stopping portion, are formed in the distal portions of the left and right arm portions 37. Contact surfaces 46, each serving as a second movement stopping portion, are formed in the left and right frame portions 17, which face the corresponding left and right arm portions 37. Each one of the contact surfaces 45 and the corresponding one of the contact surfaces 46 thus face each other. The contact surface 45 of each of the left and right arm portions 37 is inclined with respect to the contact surface 46 of the corresponding one of the left and right frame portions 17. A pivot permitting clearance 47 is defined between the contact surfaces 45, 46. The pivot axis 41*a*, which extends between the left and right support holes 41, is located between the contact surfaces 43, 44, or the first movement stopping portions, and the contact surfaces 45, 46, or the second movement stopping portions.

Figure 6A:
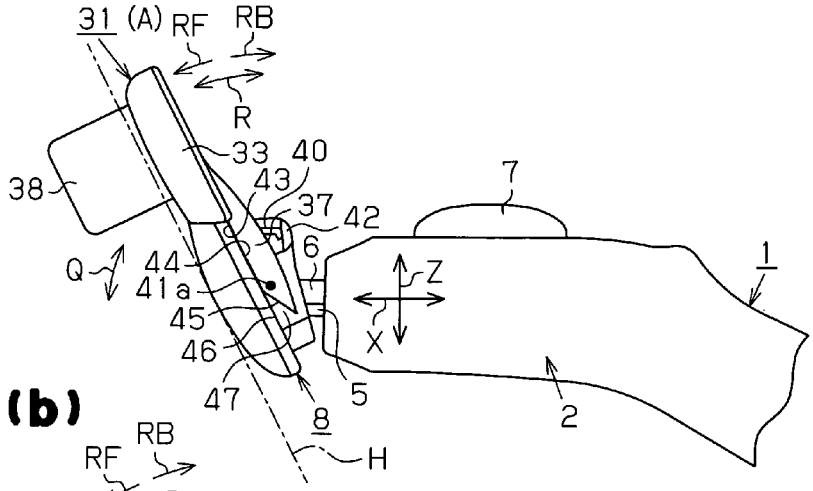
FIG. 6(*a*) is a side view illustrating a state in which the shaving aid member is arranged at an initial position in the razor head supported by the head of the holder.
Figure 6B:
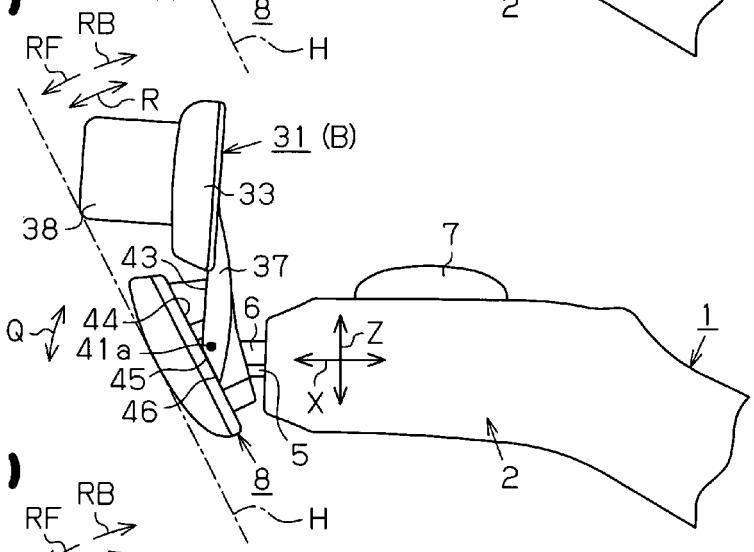
Figure 6C:
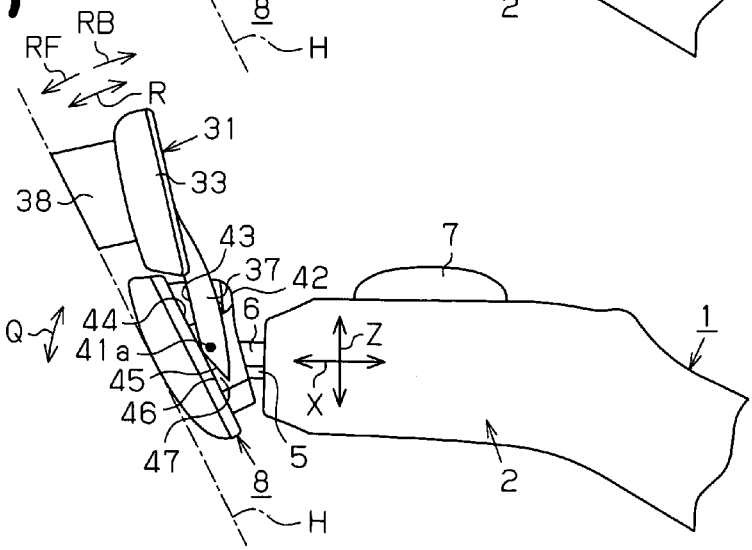

With the left and right support arms 3 spread open with respect to each other, the outer arm portions 5 of the support arms 3 are inserted into the hollow portions 26 of the left and right attaching portions 21 from the inlets 26*a* in the directions indicated by the arrows 29. The left and right support arms 3 are then maximally closed so that, as illustrated in FIG. 6(*a*), the razor head 8 is switched to the attached state in which the razor head 8 is supported in such a manner that the razor head 8 can oscillate with respect to the head 2 of the holder 1. At this stage, by matching arrows 6*b* of the left and right outer arm portions 6 of the pushers 4 with the arrows 29, the arrows 6*b* are used as guides that indicate the positions at which the left and right support arms 3 are inserted into the hollow portions 26.

Figure 7A:
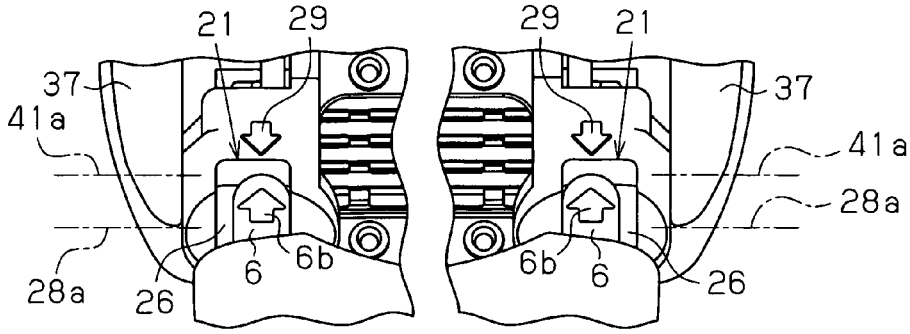
FIG. 7(*a*) is a rear view illustrating a portion of a support structure of the razor head with respect to two support arms and a portion of a pressing contact structure of a pusher with respect to the razor head.
Figure 7B:
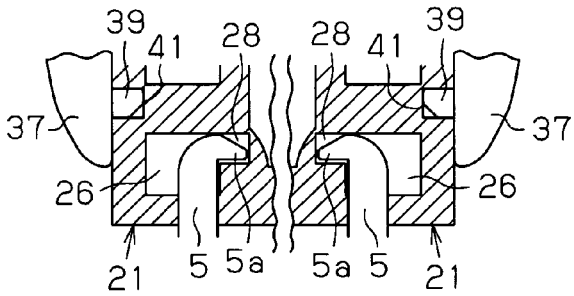
Figure 7C:
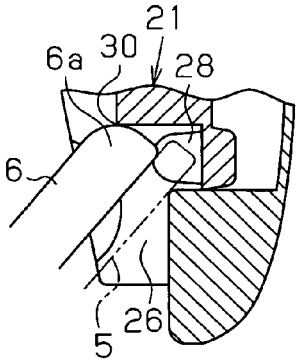

In the attached state, as illustrated in FIGS. 7(*a*), 7(*b*), and 7(*c*), the hook-like end portions 5*a* of the left and right outer arm portions 5 are inserted into and supported by the attaching openings 28 of the left and right attaching portions 21. The press contact end portions 6*a* of the left and right outer arm portions 6 of the pushers 4 are pressed against and held in contact with the pressing portions 30 of the left and right attaching portions 21 in the directions indicated by the arrows 6*b*. The razor head 8 is thus allowed to oscillate about the pivot axis 28*a* extending between the left and right attaching openings 28 in an oscillating direction Q together with the shaving aid member 31. With reference to FIGS. 2(*a*), 2(*b*), 2(*c*), 2(*d*), 5(*a*), 5(*b*), and 6(*a*), the pivot axis 41*a* of the shaving aid member 31 with respect to the razor head 8 is located closer to the upper frame portion 12 of the top plate 10 than the pivot axis 28*a* extending between the left and right attaching openings 28. The pivot axis 41*a* is arranged at a position rearward from a skin contact surface H extending in such a manner as to connect the guard 14 and the upper frame portion 12 to each other and closer to the upper frame portion 12 than the guard 14. Further, the pivot axis 41*a* is provided between the guard 14 and the upper frame portion 12, more specifically, the cutting edge 11*a* closest to the guard 14 and the cutting edge 11*a* closest to the upper frame portion 12.

As illustrated in FIG. 6(*a*), with the two leaf springs 40 of the base member 32 supported by the press contact plate portions 42 of the attaching portions 21, the shaving aid member 31 is urged by the leaf springs 40 from the backside to the front side of the razor head 8, or in a proceeding direction RF of a pivotal reciprocating direction R, which includes the proceeding direction RF and a returning direction RB. When the arm portions 37 overlap the corresponding frame portions 17 of the blade base 9, each facing pair of the contact surfaces 43, 44, or the first movement stopping portions, contact each other. This stops the shaving aid member 31 at an initial position A. When the shaving aid member 31 is located at the initial position A, the shaving aid 38 projects forward with respect to the skin contact surface H.

With reference to FIG. 6(*b*), when in use, the shaving aid member 31 pivots from the front side to the backside of the razor head 8, or in the returning direction RB, starting from the initial position A against the elastic force of the leaf springs 40 by the amount corresponding to the pivot permitting clearance 47 between each facing pair of the contact surfaces 45, 46. The shaving aid member 31 stops at a pivot position B, at which each facing pair of the contact surfaces 45, 46 contact each other. The shaving aid member 31 is permitted to oscillate with respect to the razor head 8 in a predetermined pivot range from the initial position A to the pivot position B. The oscillating angle of the shaving aid member 31 in the pivot range is set to 0° to 60°, or preferably to 0° to 45°.

If the shaving aid 38 reduces when in use and the height of the shaving aid 38 from the surface of the base member 32 decreases, the shaving aid member 31 pivots in the proceeding direction in correspondence with the amount by which the shaving aid 38 has reduced. The surface of the shaving aid 38 is thus held in contact with the surface of the skin as illustrated in FIG. 6(*c*). If the shaving aid 38 reduces to the level close to the surface of the base member 32 when used, for example, a portion of the surface of the shaving aid 38 reaches the surface of the base member 32, it is indicated that the razor head 8 and the shaving aid member 31 should be replaced.

The elastic force applied to each pusher 4, which presses and contacts the razor head 8, and the elastic force of each leaf spring 40 applied to the shaving aid member 31 may be set to various values. For example, in the present embodiment, the elastic force applied to the pusher 4 is set to a value greater than the elastic force of the leaf spring 40. Accordingly, when the razor head 8 and the shaving aid member 31 are held in contact with the surface of the skin, the shaving aid member 31 pivots integrally with the razor head 8 after the shaving aid member 31 pivots from the initial position A with respect to the razor head 8 and reaches or moves toward the pivot position B. The razor head 8 thus oscillates together with the shaving aid member 31 in the oscillating direction Q.

By removing the outer arm portions 5 from the hollow portions 26 of the attaching portions 21 with the two support arms 3 spread open with respect to each other, the razor head 8 can be detached from the head 2 of the holder 1. The support arms 3 cannot be spread open if the manipulating knob 7 is depressed only slightly. Specifically, so as to prevent the razor head 8 from being detached from the head 2 of the holder 1 when the manipulating knob 7 is accidentally pressed, the support arms 3 spread open only when the depressing amount of the manipulating knob 7 exceeds a predetermined value.

The present embodiment has the following advantages.

The shaving aid member 31 pivots with respect to the razor head 8 in the predetermined range from the initial position A to the pivot position B against the elastic force of each leaf spring 40. The shaving aid member 31 is thus held in contact with the surface of the skin with an appropriate level of elastic force, which enhances comfort in use.

Of the mounting portion 33 and the two arm portions 37 of the base member 32 of the shaving aid member 31, the mounting portion 33 is arranged adjacent to the razor head 8, but the arm portions 37 overlap the backside of the razor head 8 at the inner side of the backside. The arm portions 37 are thus invisible from the front side of the razor head 8. Accordingly, the arm portions 37 do not occupy much space outside the outer peripheral portion of the razor head 8. The maximum lateral dimension W of the razor along the extending direction Y of each cutting edge 11*a* is determined only in correspondence with the lateral dimension of the razor head 8. This reduces the surface area of the front side of the portion outlined by the razor head 8 and the shaving aid member 31. As a result, the razor is compact-sized.

The shaving aid member 31 is arranged at the side opposite to the guard 14 with respect to the razor head 8. The shaving aid member 31 is thus provided compactly with respect to the razor head 8, enhancing comfort in use of the razor. Further, the radius of pivot of the shaving aid 38 with respect to the pivot axis 41*a* is increased. The oscillating angle of the shaving aid 38 is thus reduced.

The present invention may be embodied in the following manners other than the present embodiment.

The base member 32 of the shaving aid member 31 and the blade base 9 of the razor head 8 may be formed integrally with each other and joined together at a coupling portion on the backside of the razor head 8. The coupling portion is used as the pivot axis of the shaving aid member 31 with respect to the razor head 8.

In the razor having the razor head 8 formed integrally with the head 2 of the holder 1, the shaving aid member 31 is pivotally supported by the razor head 8.

In the above illustrated embodiment, the mounting portion 33 of the base member 32 of the shaving aid member 31 is arranged at the side opposite to the guard 14 with respect to the razor head 8. However, the mounting portion may be arranged at the same side as the guard 14 with respect to the razor head 8 or at both sides of the guard 14.

The shaving aid member 31 may be detachable from the razor head 8 so that the shaving aid member 31 can be replaced.

A single leaf spring 40 may be formed as one body at the center of the left-right direction Y with respect to the base member 32 of the shaving aid member 31 or the blade base 9 or the top plate 10 of the razor head 8. The leaf spring 40 urges the shaving aid member 31. Alternatively, three or more leaf springs 40 may be aligned along the left-right direction Y.

The shaving aid 38 may be provided in a solid form or a liquid form. If the solid form is employed, the shaving aid 38 is attached directly to the base member 32. In the case of the liquid form, a soft or hard porous body such as a sponge, a pumice, or a porous body formed of tetrafluoroethylene resin fiber is impregnated with the shaving aid 38. The impregnated body is then attached to the base member 32. It is preferable that the porous body be capable of maintaining its outline. The pore diameter of the porous body may be set to various values but is set preferably to 0.01 to 50 μm.

The shaving aid 38 may be formed integrally with the base member 32 through insert injection molding. Alternatively, the shaving aid 38 in the solid form or any one of the above-listed porous bodies may be provided independently from the base member 32 and then attached to the base member 32.

In the shaving aid member 31, the shaving aid 38 may be arranged at the outer circumference of a roller that is rotatably supported by the base member 32.

A cap may be provided on the razor head 8 and the shaving aid member 31 so as to protect the blade body 11 and the shaving aid 38.

The oscillating type razor of the above illustrated embodiment is mainly used to shave the hair on the arms and legs. However, the razor may be employed to shave the face.

The invention claimed is:

1. A razor including a shaving aid member attached to a razor head having a blade body, the razor comprising a coupling portion provided at a backside of the razor head opposite to a front side of the razor head through which a cutting edge of the blade body is exposed, the coupling portion supporting the shaving aid member such that the shaving aid member is movable with respect to the razor head, wherein the coupling portion includes a base member having an arm portion, the shaving aid member has a shaving aid mounted thereon, and the coupling portion includes a support portion provided at the backside of the razor head, wherein the arm portion is supported to be movable with respect to the support portion in such a manner that the arm portion faces the backside of the razor head surrounded by an outer peripheral portion of the razor head, wherein the shaving aid member is capable of reciprocating and is movable in a predetermined movement range between an initial position, at which the shaving aid member is urged by elastic force of an elastic body in a proceeding direction and stops, and a movement position, to which the shaving aid member is moved in a returning direction against the elastic force of the elastic body, wherein the razor further comprises a first movement stopping portion that prevents the shaving aid member from moving in the proceeding direction beyond the initial position and a second movement stopping portion that prevents the shaving aid member from moving in the returning direction beyond the movement position, wherein the movement of the shaving aid member is pivoting motion and the axis of the pivoting motion of the shaving aid member is located between the first movement stopping portion and the second movement stopping portion, wherein the shaving aid member is supported in such a manner that the shaving aid member is allowed to oscillate about a pivot axis extending in an extending direction of the cutting edge of the blade body between the initial position and the movement position, wherein the razor head is supported in an attaching portion provided at each of two sides of the blade body at the backside of the razor head in such a manner that the razor head is allowed to pivot about the pivot axis extending in the extending direction of the cutting edge of the blade body with respect to a holder, and wherein the attaching portions having a pivot axis of the razor head and the coupling portion having the pivot axis of the shaving aid member are aligned along the extending direction of the cutting edge of the blade body.

2. The razor according to claim 1, wherein the second movement stopping portion has a movement permitting space between a contact surface provided on the backside of the razor head and a contact surface provided in the arm portion of the base member.

3. The razor according to claim 1, further comprising two of the coupling portion, wherein one of the coupling portions is arranged at each of two sides of the cutting edge of the blade body at the backside of the razor head.

4. The razor according to claim 3, wherein the elastic body is provided in the base member of the shaving aid member.

5. The razor according to claim 4, wherein the elastic body is provided between the arm portions of the two coupling portions in the base member.

6. The razor according to claim 3, wherein the razor head is supported by the holder at the attaching portions provided at the backside of the razor head, the attaching portions being arranged between the support portions of the two coupling portions.

7. The razor according to claim 1, wherein a guard is provided in an assembling member of the razor head in which the blade body is mounted in such a manner that the guard faces the cutting edge of the blade body, and wherein the shaving aid member is aligned at the side opposite to the guard with respect to the assembling member of the razor head.

8. The razor according to claim 7, wherein, in the assembling member, the blade body is provided between a blade base and a top plate of the assembling member of the razor head, and the cutting edge of the blade body is exposed to the front side of the top plate, and wherein, when the shaving aid member is at the initial position, a shaving aid projects from a skin contact surface connecting the guard and the top plate to each other to the front side of the top plate.

9. The razor according to claim 1, wherein the arm portion is arranged inside a range corresponding to the backside of the razor head and overlaps the backside.

* * * * *